US011286734B2

(12) United States Patent
Suter et al.

(10) Patent No.: US 11,286,734 B2
(45) Date of Patent: Mar. 29, 2022

(54) FINE CONTROL OF CASING PRESSURE

(71) Applicant: M-I L.L.C., Houston, TX (US)

(72) Inventors: Roger Suter, Katy, TX (US); David Molley, Prairieville, LA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 100 days.

(21) Appl. No.: 14/365,921

(22) PCT Filed: Dec. 13, 2012

(86) PCT No.: PCT/US2012/069514

§ 371 (c)(1),
(2) Date: Jun. 16, 2014

(87) PCT Pub. No.: WO2013/090578

PCT Pub. Date: Jun. 20, 2013

(65) Prior Publication Data

US 2014/0352951 A1 Dec. 4, 2014

Related U.S. Application Data

(60) Provisional application No. 61/570,984, filed on Dec. 15, 2011.

(51) Int. Cl.

| | |
|---|---|
| ***E21B 21/08*** | (2006.01) |
| ***E21B 43/12*** | (2006.01) |
| ***E21B 47/06*** | (2012.01) |

(52) U.S. Cl.

CPC ..... *E21B 21/08* (2013.01); *E21B 43/12* (2013.01); *E21B 47/06* (2013.01)

(58) Field of Classification Search

CPC ..... E21B 21/08; E21B 43/12; E21B 47/06; E21B 21/00; E21B 21/082; E21B 21/085

See application file for complete search history.

(56) References Cited

U.S. PATENT DOCUMENTS

| | | | | |
|---|---|---|---|---|
| 4,253,530 | A | 3/1981 | Sharki et al. | |
| 6,253,787 | B1 | 7/2001 | Suter et al. | |
| 6,575,244 | B2 | 6/2003 | Chang et al. | |
| 7,004,448 | B2 | 2/2006 | Suter et al. | |
| 7,363,937 | B2 | 4/2008 | Suter et al. | |
| 8,281,875 | B2 | 10/2012 | Lovorn et al. | |
| 8,490,719 | B2 | 7/2013 | Duhe et al. | |
| 2003/0024737 | A1 * | 2/2003 | Chang | E21B 21/08 175/25 |
| 2005/0092523 | A1 | 5/2005 | McCaskill et al. | |

(Continued)

OTHER PUBLICATIONS

"Real-time" McGraw-Hill Dictionary of Scientific and Technical Terms (6th ed., 2003) on p. 1758, 1 page.

(Continued)

*Primary Examiner* — Krysten A Hall
(74) *Attorney, Agent, or Firm* — Kelly McKinney

(57) ABSTRACT

Back pressure control devices used to control fluid pressure in a wellbore require various utilities for operation, such as an air supply. Apparatus disclosed herein provide for the continued operation of one or more back pressure control devices when supply of utilities for operation of the back pressure control devices are intentionally or unintentionally interrupted.

19 Claims, 6 Drawing Sheets

(56) References Cited

U.S. PATENT DOCUMENTS

| | | | | |
|---|---|---|---|---|
| 2009/0260698 | A1 | 10/2009 | Suter | |
| 2010/0288506 | A1* | 11/2010 | Lemetayer | E21B 43/00 166/369 |
| 2010/0288507 | A1* | 11/2010 | Duhe | E21B 21/08 166/370 |
| 2013/0146358 | A1* | 6/2013 | DiSantis | E21B 7/00 175/27 |

OTHER PUBLICATIONS

International Search Report of PCT Application Serial No. PCT/US2012/069514 dated Apr. 8, 2013 (4 pages).
Extended European Search Report regarding corresponding application No. 12857683.2, dated Jul. 1, 2016.
Brazilian Office Action dated Dec. 12, 2019, of the equivalent Brazilian Patent Application 112014014690.0.
Eurasian Office Action dated Aug. 24, 2015, of the equivalent Eurasian Patent Application 201491181.
Eurasian Office Action dated Oct. 7, 2016, of the equivalent Eurasian Patent Application 201491181.
Eurasian Office Action dated Aug. 31, 2017, of the equivalent Eurasian Patent Application 201491181.
Eurasian Office Action dated Apr. 11, 2019, of the equivalent Eurasian Patent Application 201491181.
Eurasian Office Action dated Jun. 11, 2020, of the equivalent Eurasian Patent Application 201491181.
IPRP dated Jun. 26, 2014, of the equivalent PCT Application PCT/US2012/069514.
Canadian Office Action dated Jul. 16, 2015, of the equivalent CA-PCT patent granted 2859372.
EPT Article 94(3) dated Jan. 31, 2017, of the equivalent EPT patent publication 2791463.

* cited by examiner

FINE CONTROL OF CASING PRESSURE

BACKGROUND

There are many applications in which there is a need to control the back pressure of a fluid flowing in a system. For example, in the drilling of oil wells it is customary to suspend a drill pipe in the wellbore with a bit on the lower end thereof and, as the bit is rotated, to circulate a drilling fluid, such as a drilling mud, down through the interior of the drill string, out through the bit, and up the annulus of the wellbore to the surface. Traditional drilling practices rely on pressure created by the drilling mud as it circulates through the drillstring to prevent formations fluids from entering the wellbore. Ideally, this equivalent circulating density (ECD) is greater than the pore pressure but less than the fracture gradient of the formations being drilled. ECD is the effective density exerted by a circulating fluid against the formation. As the ECD approaches or exceeds the fracture gradient, casing must be set to prevent fracturing the formation. As the ECD approaches or goes below the pore pressure, increasing the drilling mud density or adding back pressure is required to manage or prevent formation flow. Thus, in some instances, a back pressure control device is mounted in the return flow line for the drilling fluid.

Back pressure control devices are also necessary for controlling "kicks" in the system caused by the intrusion of salt water or formation fluids or gases into the drilling fluid which may lead to a blowout condition. In these situations, sufficient additional back pressure must be imposed on the drilling fluid such that the formation fluid is contained and the well controlled until heavier fluid or mud can be circulated down the drill string and up the annulus to kill the well. It is also desirable to avoid the creation of excessive back pressures which could cause the drill string to stick, or cause damage to the formation, the well casing, or the well head equipment.

Mud weight is the primary means of pressure control. During drilling, the annular pressure profile is preferably maintained between the pore pressure and the fracture pressure. Pore pressure is defined as the pressure being exerted into the wellbore by fluids or gases within the pore spaces of the formation (also known as the formation pressure). Fracture gradient is defined as the pressure required to physically rupture the formation and cause fluid losses. Maintaining the fluid pressure between the pore and fracture pressures should provide a stable well, i.e., no fluid intrusion into the wellbore (a kick) or formation breakdown.

However, maintenance of an optimum back pressure on the drilling fluid is complicated by variations in certain characteristics of the drilling fluid as it passes through the back pressure control device. For example, the density of the fluid can be altered by the introduction of debris or formation fluids or gases, and/or the temperature and volume of the fluid entering the control device can change. Therefore, the desired back pressure will not be achieved until appropriate changes have been made in the throttling of the drilling fluid in response to these changed conditions. Conventional devices, such as a choke, generally require manual control of and adjustments to the back pressure control device orifice to maintain the desired back pressure.

In conventional drilling, the choke controls the operating pressures within acceptable ranges. Operating pressures which may be controlled include the following: casing pressure (CSP); drill pipe pressure (DPP); and bottom hole pressure (BHP). Acceptable ranges of current control systems provide stable control within +/−50 psig.

Accordingly, there exists a need for a method for operating the controlling operating pressures within a narrower window.

DETAILED DESCRIPTION

In one aspect, embodiments disclosed herein relate to a method of controlling a casing pressure within a wellbore. The method includes sensing a casing pressure within the wellbore and comparing the casing pressure with a target casing pressure. A signal representative of the difference between the casing pressure and the target casing pressure is generated and processed to provide a set point pressure signal for controlling the operation of an automatic choke. The set point pressure of the automatic choke is adjusted using the generated set point pressure signal.

In another aspect, embodiments disclosed herein relate a system for controlling one or more operating pressures within a subterranean borehole. The system includes a sensor, a plurality of controllers, and a valve. The sensor is configured to sense an operating pressure within a tubular member and generating an actual tubular member pressure signal representative of the actual operating pressure within the tubular member. At least one controller is configured comparing the actual tubular member pressure signal with a target tubular member pressure signal representative of a target operating pressure within the tubular member and generating an error signal representative of the difference between the actual tubular member pressure signal and the target tubular member pressure signal, wherein the means for comparing comprises a PID controller. At least one controller is configured to process the error signal to generate a set point pressure signal for controlling the operation of the automatic choke, wherein the controller for processing comprises a PID controller. The valve is configured to control the automatic choke. The borehole includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole.

In another aspect, embodiments disclosed herein relate to a method for controlling a back pressure control system. In another aspect, embodiments disclosed herein relate to a method of implementing fine control of casing pressure during drilling operations. In another aspect, embodiments disclosed herein relate to a system for controlling one or more operating pressures during drilling operations.

Back pressure control systems useful in embodiments disclosed herein may include those described in, for example, U.S. Pat. Nos. 7,004,448 and 6,253,787, U.S. Patent Application Publication No. 20060011236, and U.S. patent application Ser. No. 12/104,106 (assigned to the assignee of the present application), each of which is incorporated herein by reference.

Figure 1:
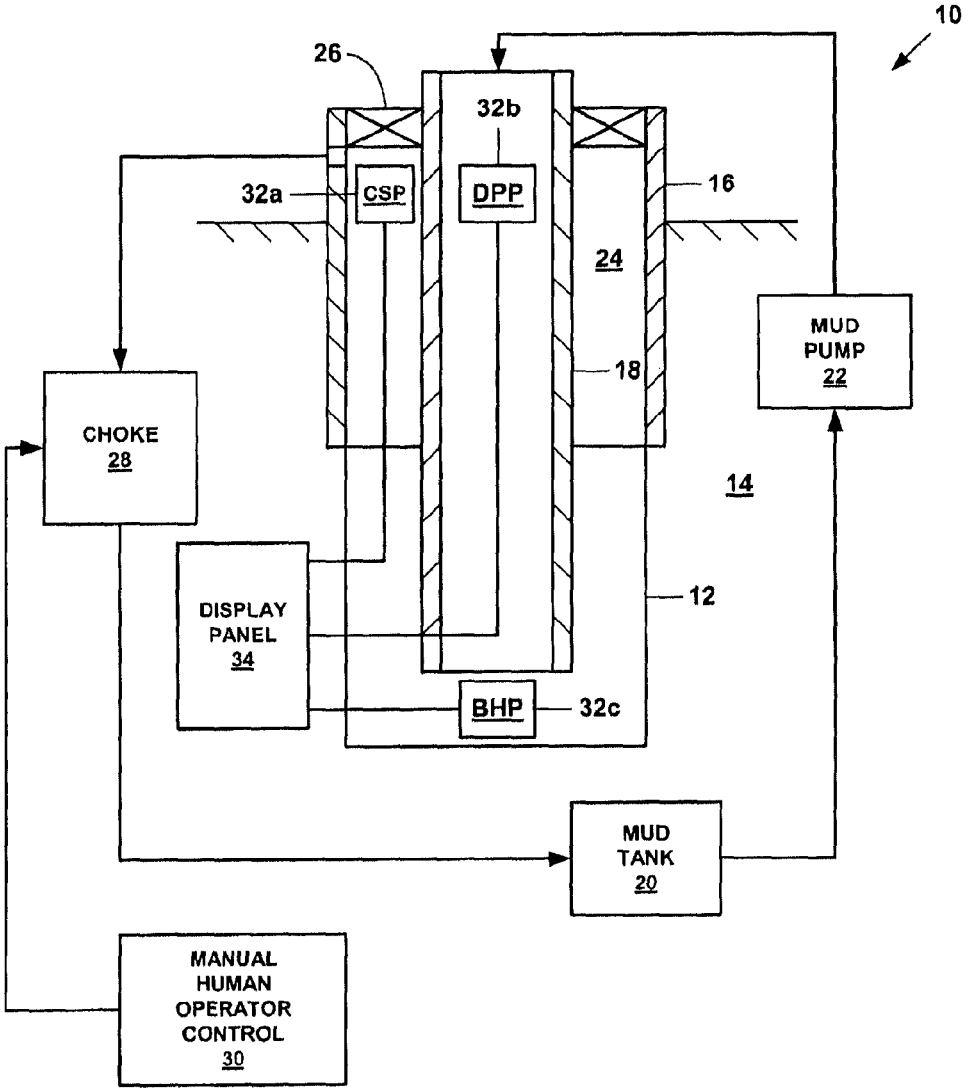
FIG. 1 is a schematic illustration of an embodiment of a conventional oil or gas well.

Referring to FIG. 1, a typical oil or gas well 10 includes a wellbore 12 that traverses a subterranean formation 14 and includes a wellbore casing 16. During operation of the well 10, a drill pipe 18 may be positioned within the wellbore 12 in order to inject fluids such as, for example, drilling mud into the wellbore. As will be recognized by persons having ordinary skill in the art, the end of the drill pipe 18 may include a drill bit and the injected drilling mud may used to cool the drill bit and remove particles drilled away by the drill bit. A mud tank 20 containing a supply of drilling mud may be operably coupled to a mud pump 22 for injecting the drilling mud into the drill pipe 18. The annulus 24 between the wellbore casing 16 and the drill pipe 18 may be sealed in a conventional manner using, for example, a rotary seal 26.

In order to control the operating pressures within the well 10 such as, for example, within acceptable ranges, a choke 28 may be placed within the annulus 24 between the wellbore casing 16 and the drill pipe 18 in order to controllably bleed off pressurized fluidic materials out of the annulus 24 back into the mud tank 20 to thereby create back pressure within the wellbore 12.

The choke 28 is manually controlled by a human operator 30 to maintain one or more of the following operating pressures within the well 10 within acceptable ranges: (1) the operating pressure within the annulus 24 between the wellbore casing 16 and the drill pipe 18—commonly referred to as the casing pressure (CSP); (2) the operating pressure within the drill pipe 18—commonly referred to as the drill pipe pressure (DPP); and (3) the operating pressure within the bottom of the wellbore 12—commonly referred to as the bottom hole pressure (BHP). In order to facilitate the manual human control 30 of the CSP, the DPP, and the BHP, sensors, 32*a*, 32*b*, and 32*c*, respectively, may be positioned within the well 10 that provide signals representative of the actual values for CSP, DPP, and/or BHP for display on a conventional display panel 34. Typically, the sensors, 32*a* and 32*b*, for sensing the CSP and DPP, respectively, are positioned within the annulus 24 and drill pipe 18, respectively, adjacent to a surface location. The operator 30 may visually observe one of the more operating pressures, CSP, DPP, and/or BHP, using the display panel 34 and attempt to manually maintain the operating pressures within predetermined acceptable limits by manually adjusting, the choke 28. If the CSP, DPP, and/or the BHP are not maintained within acceptable ranges, an underground blowout may occur thereby potentially damaging the production zones within the subterranean formation 14. In some embodiments, an alert may be generated to notify the operator if the casing pressure is out of an acceptable range.

Back pressure control systems useful in embodiments disclosed herein may include those described in, for example, U.S. Patent Nos. 7,004,448 and 6,253,787, U.S. Patent Application Publication No. 20060011236, and U.S. patent application Ser. No. 12/104,106 (assigned to the assignee of the present application), each of which is incorporated herein by reference.

Figure 2:
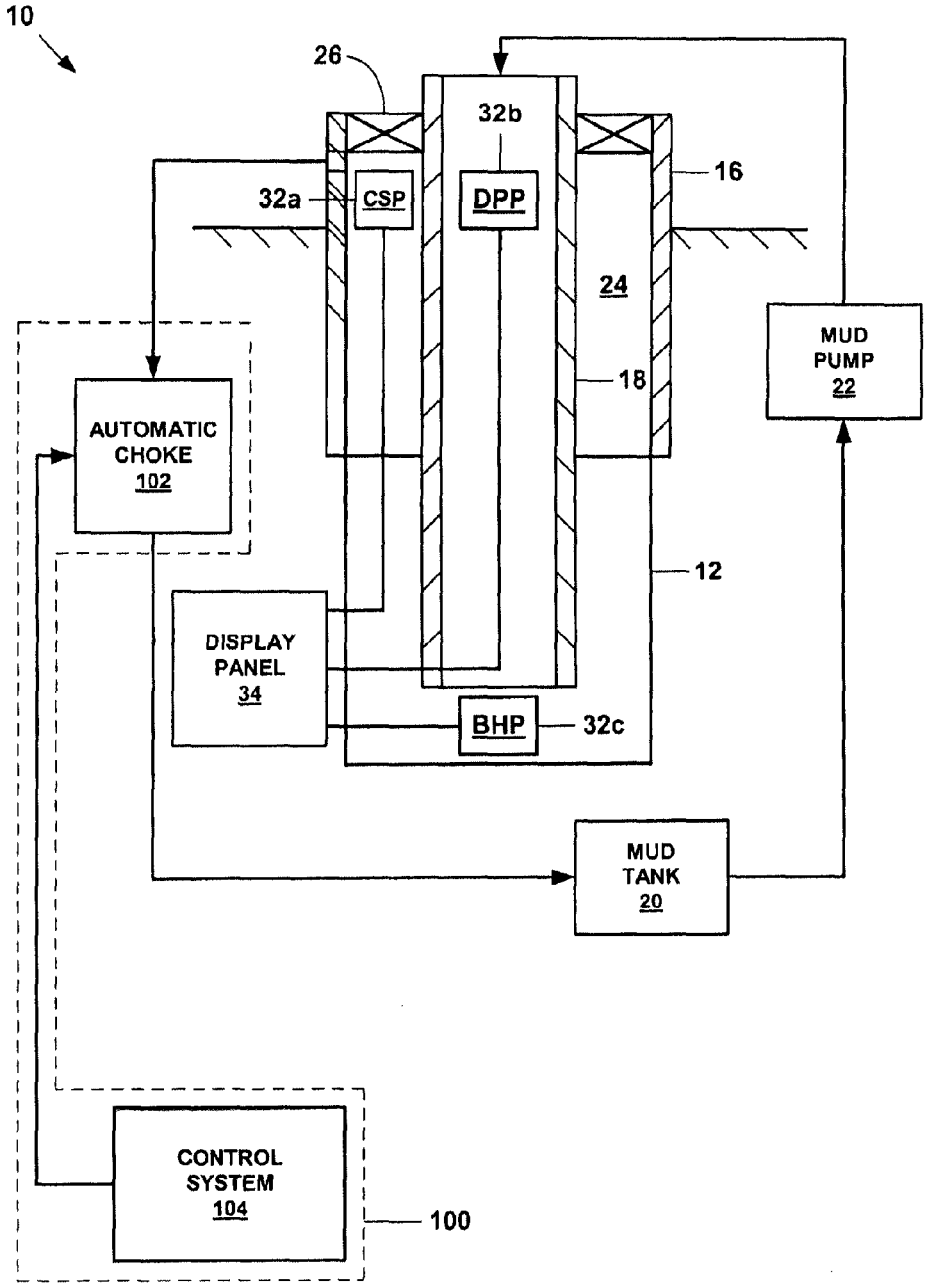
FIG. 2 is a schematic illustration of an embodiment of a system for controlling the operating pressures within an oil or gas well.
Figure 3:
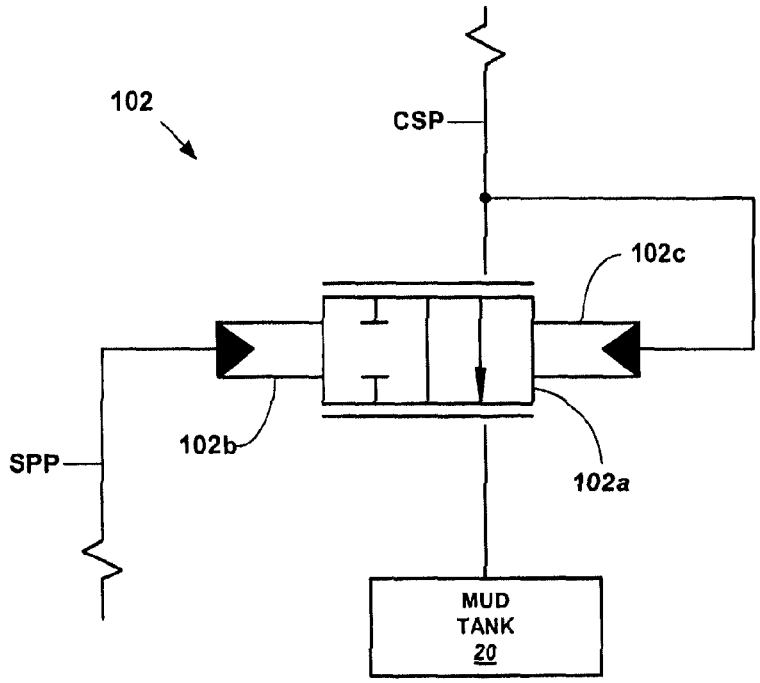
FIG. 3 is a schematic illustration of an embodiment of the automatic choke of the system of FIG. 2.

Referring to FIGS. 2-3, the reference numeral 100 refers, in general, to an embodiment of a system for managed pressure drilling within the oil or gas well 10 that includes an automatic choke 102 for controllably bleeding off the pressurized fluids from the annulus 24 between the wellbore casing 16 and the drill pipe 18 to the mud tank 20 to thereby create back pressure within the wellbore 12 and a control system 104 for controlling the operation of the automatic choke.

As illustrated in FIG. 3, the automatic choke 102 includes a movable valve element 102*a* that defines a continuously variable flow path depending upon the position of the valve element 102*a*. The position of the valve element 102*a* is controlled by a first control pressure signal 102*b*, and an opposing second control pressure signal 102*c*. In an exemplary embodiment, the first control pressure signal 102*b* is representative of a set point pressure (SPP) that is generated by the control system 104, and the second control pressure signal 102*c* is representative of the CSP. In this manner, if the CSP is greater than the SPP, pressurized fluidic materials within the annulus 24 of the well 10 are bled off into the mud tank 20. Conversely, if the CSP is equal to or less than the SPP, then the pressurized fluidic materials within the annulus 24 of the well 10 are not bled off into the mud tank 20. In this manner, the automatic choke 102 provides a pressure regulator than can controllably bleed off pressurized fluids from the annulus 24 and thereby also controllably create back pressure in the wellbore 12. In an exemplary embodiment, the automatic choke 102 is further provided substantially as described in U.S. Pat. No. 6,253,787, the disclosure of which is incorporated herein by reference. When the automatic choke 102 is used to regulate the pressure, i.e., the CSP, DPP, and/or the BHP, the control may be precise, reliable, and predictable.

Figure 4:
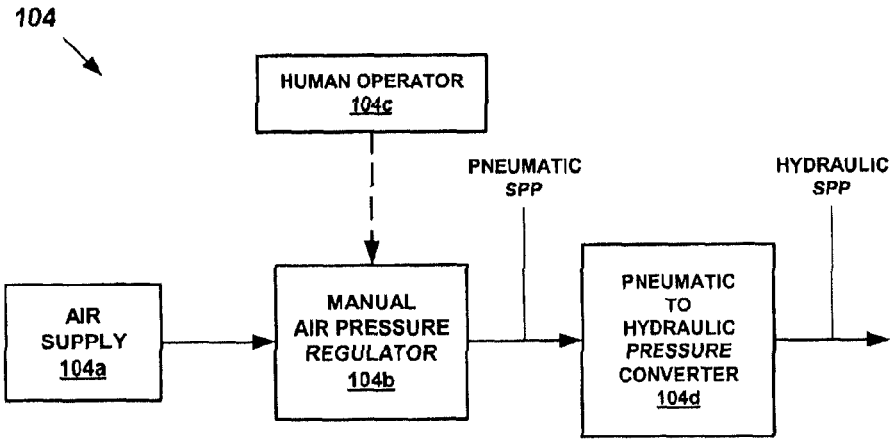
FIG. 4 is a schematic illustration of an embodiment of a control system of the system of FIG. 2.

As illustrated in FIG. 4, the control system 104 includes a conventional air supply 104*a* that is operably coupled to a conventional manually operated air pressure regulator 104*b* for controlling the operating pressure of the air supply. A human operator 104*c* may manually adjust the air pressure regulator 104*b* to generate a pneumatic SPP. The pneumatic SPP is then converted to a hydraulic SPP by a conventional pneumatic to hydraulic pressure converter 104*d*. The hydraulic SPP is then used to control the operation of the automatic choke 102. The system 100 permits the CSP to be automatically controlled by the human operator 104*c* selecting the desired SPP. The automatic choke 102 then regulates the CSP as a function of the selected SPP.

In some embodiments, apparatus for controlling back pressure control systems described herein may additionally provide for advanced control of the system components, such as via a proportional-integral-differential (PID) controller, such as described in, for example, U.S. Pat. No. 6,575,244, which is incorporated herein by reference.

The above systems may be used to control the operating pressure within a narrow well stability window using one or more Managed Pressure Drilling (MPD) techniques. Managed pressure drilling techniques use a collection of tools to hold back pressure and more precisely controls the annular pressure profile. Managed pressure drilling methods depend upon keeping the wellbore closed at all times. MPD is preferably used to maintain the pressure in the well within a Well Stability Window determined by the drilling engineer.

Figure 5:
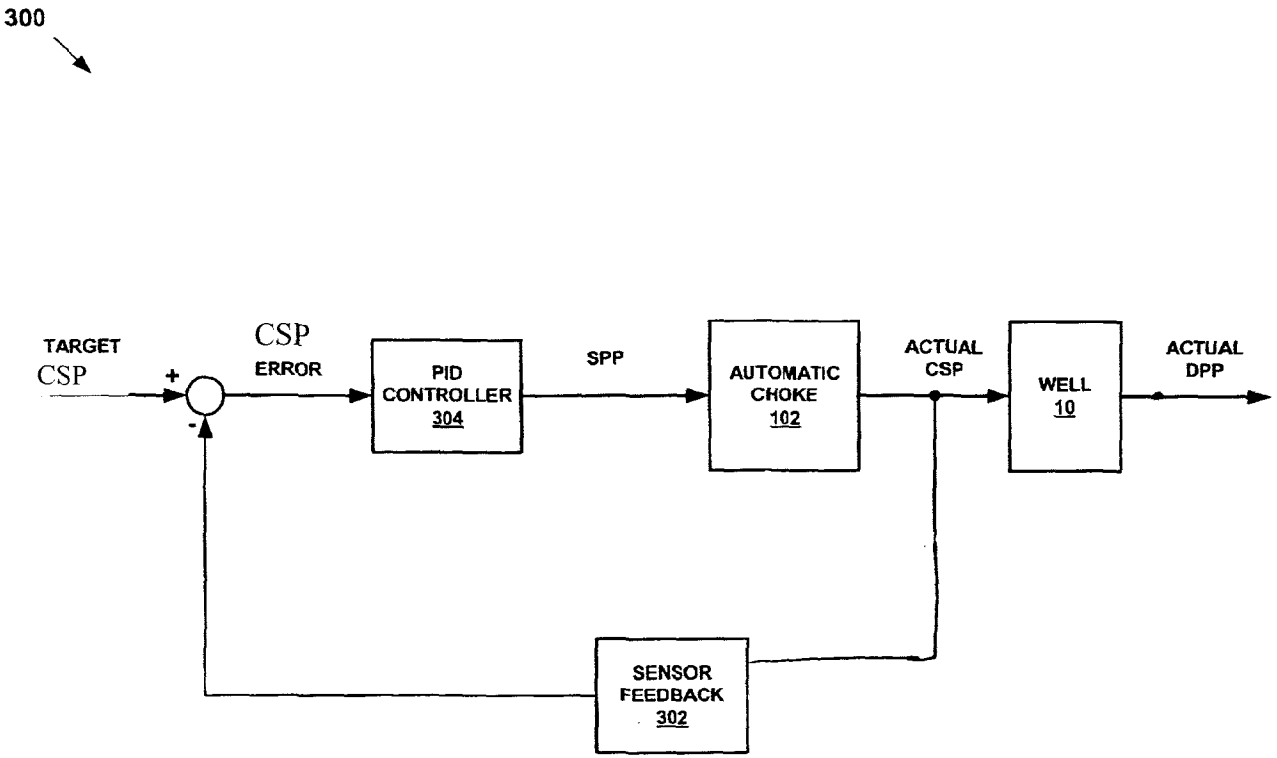
FIG. 5 is a schematic illustration of another embodiment of a control system of the system of FIG. 2.

Referring to FIGS. 2 and 5, a system 300 for controlling the operating pressures within the oil or gas well 10 includes a sensor feedback 302 that monitors the actual CSP value within the drill pipe 18 using the output signal of the sensor 32*a*. The actual CSP value provided by the sensor feedback 302 is then compared with the target CSP value to generate a CSP error that is processed by a proportional-integral-differential (PID) controller 304 to generate a hydraulic SPP.

As will be recognized by persons having ordinary skill in the art, a PID controller includes gain coefficients, Kp, Ki, and Kd, that are multiplied by the error signal, the integral of the error signal, and the differential of the error signal, respectively. In an exemplary embodiment, the PID controller 304 also includes a lag compensator and/or feedforward control. In an exemplary embodiment, the lag compensator is directed to: (1) compensating for lags due to the wellbore fluid pressure dynamics (i.e., a pressure transient time (PTT) lag); and/or (2) compensating for lags due to the response lag between the input to the automatic choke 102 (i.e., the numerical input value for SPP provided by the PID controller 304) and the output of the automatic choke (i.e., the resulting CSP). The PTT refers to the amount of time for a pressure pulse, generated by the opening or closing of the automatic choke 102, to travel down the annulus 24 and back up the interior of the drill pipe 18 before manifesting itself by altering the CSP at the surface. The PTT further varies, for example, as a function of: (1) the operating pressures in the well 10; (2) the kick fluid volume, type, and dispersion; (3) the type and condition of the mud; and (4) the type and condition of the subterranean formation 14.

In some embodiments, the adjustment of the set point pressure occurs in real time. The term "real-time" is defined in the McGraw-Hill Dictionary of Scientific and Technical Terms (6th ed., 2003) on page 1758. "Real-time" pertains to a data-processing system that controls an ongoing process and delivers its outputs (or controls its inputs) not later than the time when these are needed for effective control. In this disclosure, "in real-time" means that optimized drilling parameters for an upcoming segment of formation to be drilled are determined and returned to a data store at a time not later than when the drill bit drills that segment. The information is available when it is needed. This enables a driller or automated drilling system to control the drilling process in accordance with the optimized parameters. Thus, "real-time" is not intended to require that the process is "instantaneous."

As will be recognized by persons having ordinary skill in the art, feedforward control refers to a control system in which set point changes or perturbations in the operating environment can be anticipated and processed independent of the error signal before they can adversely affect the process dynamics. In an exemplary embodiment, the feedforward control anticipates changes in the SPP and/or perturbations in the operating environment for the well 10.

The hydraulic SPP is then processed by the automatic choke 102 to control the target CSP. The target CSP is then processed by the well 10 to adjust the actual CSP. Thus, the system 300 maintains the actual CSP within a predetermined range of acceptable values. In a preferred embodiment, the variance in the predetermined range of acceptable values for the casing pressure ranges from about 0 psi to about ±25 psi, more preferably ±10, most preferably ±5 psi. Furthermore, because the PID controller 304 of the system 300 is more responsive, accurate, and reliable than currently used control systems, the system 300 is able to control the CSP, DPP and BHP more effectively than currently used control systems.

In some embodiments, the system 300 may include two PID controllers, referred to as cascaded PID control or a cascading PID loop. The two PIDs are arranged with one PID controlling the set point of another. A PID controller acts as an outer loop controller, which controls the primary physical parameter, such as SPP. The other controller acts as an inner loop controller, which reads the output of outer loop controller as a set point, usually controlling a more rapid changing parameter, such as CSP.

Figure 6:
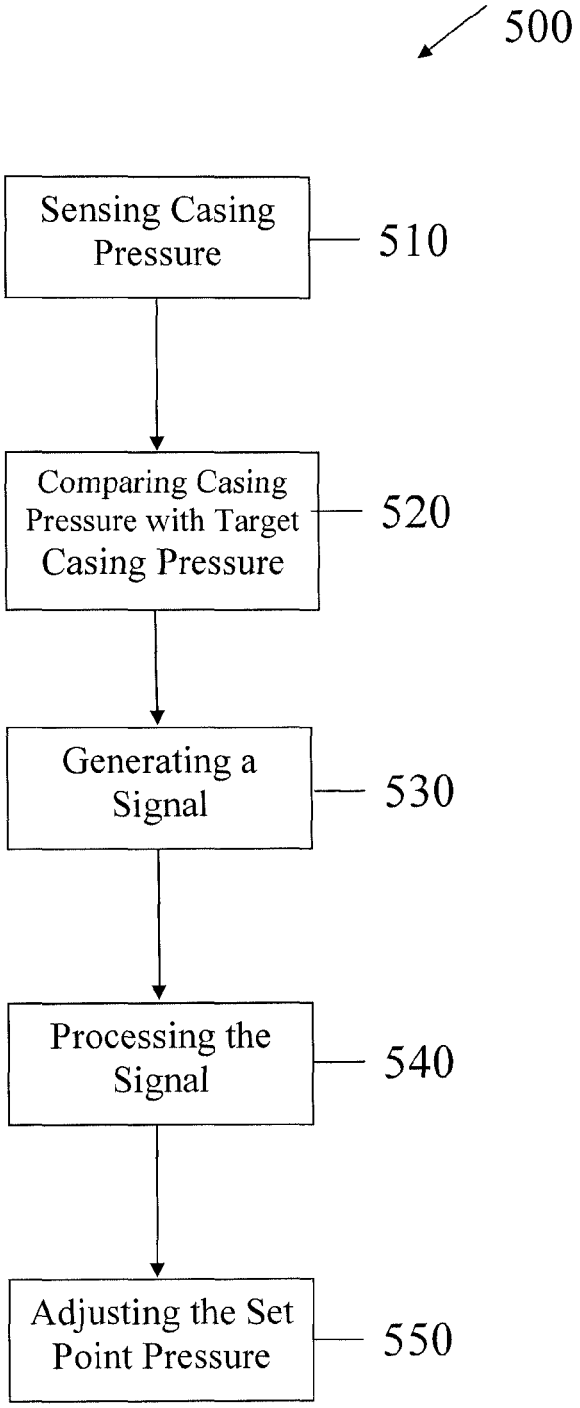
FIG. 6 is a schematic flowchart of an embodiment of a method of using the control system of FIG. 5.

Referring to FIG. 6, embodiments the present disclosure may be used for a method 500 of controlling a back pressure. The method 500 includes the steps of sensing a casing pressure 510 followed by comparing the casing pressure with a target casing pressure 520. The difference between the casing pressure and the target casing pressure may be used for generating a signal 530. Processing the signal 540 generates a set point pressure signal for controlling the operation of an automatic choke. The generated set point pressure signal may be used for adjusting the set point pressure of the automatic choke 550.

Figure 7:
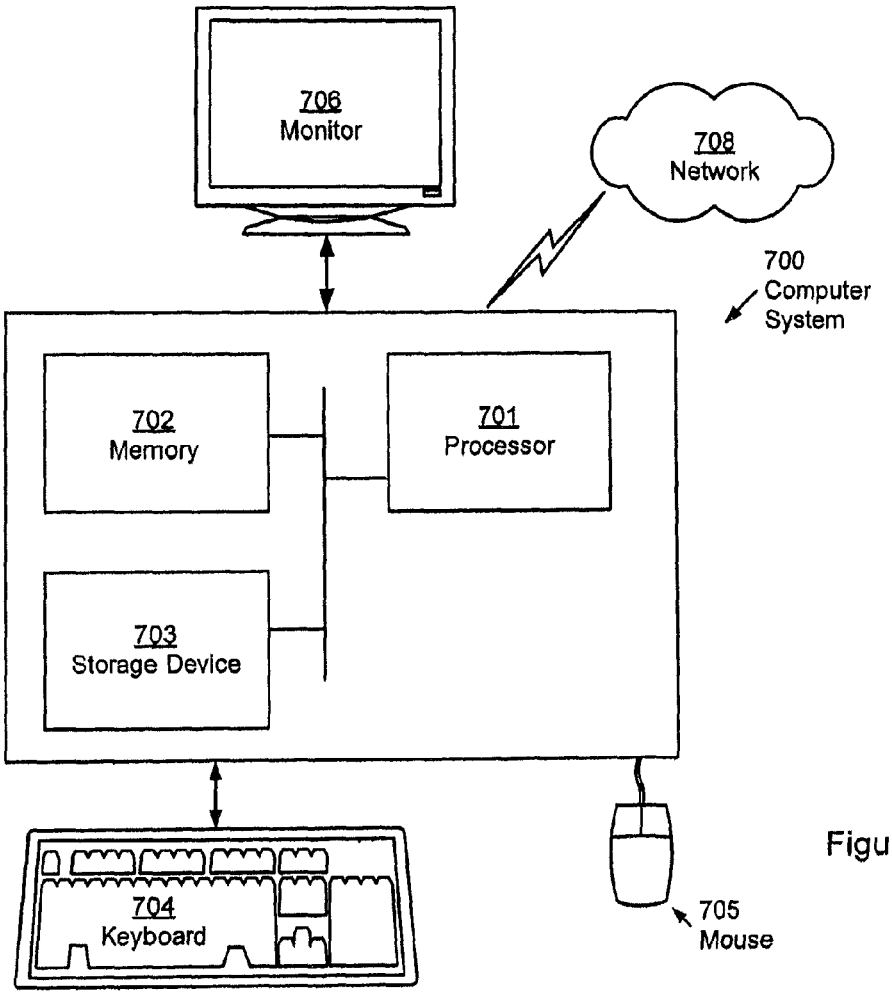
FIG. 7 is a schematic representation of a computer system according to embodiments of the present disclosure.

Embodiments of the present disclosure may be implemented on virtually any type of computer regardless of the platform being used. For example, as shown in FIG. 7, a computer system 700 includes one or more processor(s) 701, associated memory 702 (e.g., random access memory (RAM), cache memory, flash memory, etc.), a storage device 703 (e.g., a hard disk, an optical drive such as a compact disk drive or digital video disk (DVD) drive, a flash memory stick, etc.), and numerous other elements and functionalities typical of today's computers (not shown). In one or more embodiments of the present disclosure, the processor 701 is hardware. For example, the processor may be an integrated circuit. The computer system 700 may also include input means, such as a keyboard 704, a mouse 705, or a microphone (not shown). Further, the computer system 700 may include output means, such as a monitor 706 (e.g., a liquid crystal display (LCD), a plasma display, or cathode ray tube (CRT) monitor). The computer system 700 may be connected to a network 708 (e.g., a local area network (LAN), a wide area network (WAN) such as the Internet, or any other type of network) via a network interface connection (not shown). Those skilled in the art will appreciate that many different types of computer systems exist, and the aforementioned input and output means may take other forms. Generally speaking, the computer system 700 includes at least the minimal processing, input, and/or output means necessary to practice embodiments of the present disclosure.

Further, those skilled in the art will appreciate that one or more elements of the aforementioned computer system 700 may be located at a remote location and connected to the other elements over a network. Further, embodiments of the present disclosure may be implemented on a distributed system having a plurality of nodes, where each portion of the present disclosure (e.g., the local unit at the rig location or a remote control facility) may be located on a different node within the distributed system. In one embodiment of the invention, the node corresponds to a computer system. Alternatively, the node may correspond to a processor with associated physical memory. The node may alternatively correspond to a processor or microcore of a processor with shared memory and/or resources. Further, software instructions in the form of computer readable program code to perform embodiments of the invention may be stored, temporarily or permanently, on a computer readable medium, such as a compact disc (CD), a diskette, a tape, memory, or any other computer readable storage device.

The computing device includes a processor 701 for executing applications and software instructions configured to perform various functionalities, and memory 702 for storing software instructions and application data. Software instructions to perform embodiments of the invention may be stored on any tangible computer readable medium such as a compact disc (CD), a diskette, a tape, a memory stick such as a jump drive or a flash memory drive, or any other computer or machine readable storage device that can be read and executed by the processor 701 of the computing device. The memory 702 may be flash memory, a hard disk drive (HDD), persistent storage, random access memory (RAM), read-only memory (ROM), any other type of suitable storage space, or any combination thereof.

The computer system 700 is typically associated with a user/operator using the computer system 700. For example, the user may be an individual, a company, an organization, a group of individuals, or another computing device. In one or more embodiments of the invention, the user is a drill engineer that uses the computer system 700 to remotely operate back pressure control systems at a drilling rig.

Advantageously, embodiments disclosed herein may provide for continued operation of back pressure control systems during managed pressure drilling. Alternatively, the embodiments disclosed herein may provide for continued operation of back pressure control systems for use during drilling operations according to a drilling plan having multiple segments. As will be recognized by persons having ordinary skill in the art, having the benefit of the present disclosure, maintaining the pressure in a subterranean borehole is common to the formation and/or operation of, for example, oil and gas wells, mine shafts, underground structural supports, and underground pipelines. Furthermore, as will also be recognized by persons having ordinary skill in the art, having the benefit of the present disclosure, the operating pressures within subterranean structures such as, for example, oil and gas wells, mine shafts, underground structural supports and underground pipelines, typically must be controlled before, during, or after their formation. Thus, the teachings of the present disclosure may be used to control the operating pressures within subterranean structures such as, for example, oil and gas wells, mine shafts, underground structural supports, and underground pipelines.

The present embodiments of the invention provide a number of advantages. For example, the ability to control the CSP also permits control of the BHP. Furthermore, the use of a PID controller having lag compensating and/or feedforward control enhances the operational capabilities and accuracy of the control system. In addition, the monitoring of the system transient response and modeling the overall transfer function of the system permits the operation of the PID controller to be further adjusted to respond to perturbations in the system. Finally, the determination of convergence, divergence, or steady state offset between the overall transfer function of the system and the controlled variables permits further adjustment of the PID controller to permit enhanced response characteristics.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A method comprising:

sensing a casing pressure within the wellbore;

comparing the casing pressure with a target casing pressure;

generating a signal representative of the difference between the casing pressure and the target casing pressure;

processing the signal to generate a set point pressure signal for controlling the operation of an automatic choke; and adjusting the set point pressure of the automatic choke using the generated set point pressure signal to control the casing pressure within the wellbore; and adjusting the target casing pressure using the generated set point pressure signal.

2. The method of claim 1, wherein adjusting the set point pressure occurs in real time.

3. The method of claim 1, wherein adjusting the set point pressure utilizes a proportional-integral-differential controller.

4. The method of claim 1, wherein adjusting the set point pressure utilizes a cascaded proportional-integral-differential loop.

5. The method of claim 1, wherein the difference between the casing pressure and the target casing pressure is about +5 psi.

6. The method of claim 1, wherein the difference between the casing pressure and the target casing pressure is about +10 psi.

7. The method of claim 1, wherein the difference between the casing pressure and the target casing pressure is about +25 psi.

8. The method of claim 1, further comprising generating an alert to notify if the casing pressure is out of an acceptable range.

9. The method of claim 1, wherein the proportional-integral-differential controller includes a lag, compensator.

10. The method of claim 9, wherein the lag compensator compensates for lags due to wellbore fluid pressure dynamics.

11. The method of claim 9, wherein the lag compensator compensates for lags due to response lag between an input to the choke and an output to the choke.

12. The method of claim 1, wherein the proportional-integral-differential controller operates using feed forward control.

13. A system comprising:

a sensor configured to sense an operating pressure within a tubular member and generate an actual tubular member pressure signal representative of the actual operating pressure within the tubular member;

a first controller configured to compare the actual tubular member pressure signal with a target tubular member pressure signal representative of a target operating, pressure within the tubular member and also configured to generate an error signal representative of the difference between the actual tubular member pressure signal and the target tubular member pressure signal, wherein the means for comparing comprises a first proportional-integral-differential controller;

a second controller configured to process the error signal to generate a set point pressure signal for controlling the operation of an automatic choke, wherein the second controller for processing comprises a second proportional-integral-differential controller, wherein the first controller is further configured to receive the generated set point pressure signal from the second controller and adjust the target tubular member pressure signal based on the generated set point pressure signal;

a valve configured to control the automatic choke;

a sealing member for sealing an annulus between the tubular member and a borehole;

a pump for pumping fluidic materials into the tubular member; and wherein the automatic choke controllably releases fluidic materials out of the annulus.

14. The system of claim 13, wherein the first and second proportional-integral-differential controllers comprise a cascading loop.

15. The system of claim 13, wherein the operating pressure is the casing pressure.

16. The system of claim 13, wherein the operating pressure is the drill pipe pressure.

17. The system of claim 13, wherein the operating pressure is the bottomhole pressure.

18. A method of drilling a well, the method comprising:

drilling a first segment according to a drilling plan;

maintaining a casing pressure by providing a back pressure and a down hole pressure;

operating a choke to provide the back pressure, wherein the back pressure is the down hole pressure subtracted from the casing, pressure; and operating a mud pump to provide the down hole pressure;

wherein maintaining the casing pressure comprises:

sensing the casing pressure within the wellbore;

comparing the casing pressure with a target casing pressure;

generating a signal representative of the difference between the casing pressure and the target casing pressure;

processing the signal to generate a set point pressure signal for controlling the operation of the choke;

adjusting the set point pressure of the choke using the generate set point pressure signal; and adjusting the target casing pressure using the generated set point pressure signal, and wherein maintaining the casing pressure comprises using a cascading proportional-integral-differential loop.

19. The method of claim 18, wherein the cascading proportional-integral-differential loop maintains the casing pressure in real time.

* * * * *